US005203733A

United States Patent [19]

Patch et al.

[11] Patent Number: 5,203,733

[45] Date of Patent: Apr. 20, 1993

[54] TOY CAR RACETRACK ASSEMBLED FROM MULTIPLE PAPERBOARD BLANKS

[76] Inventors: Bryce L. Patch, 2704 Highcrest Rd.; Francis W. Patch, 728 N. Hill Rd., both of Beloit, Wis. 53511

[21] Appl. No.: 791,904

[22] Filed: Nov. 13, 1991

[51] Int. Cl.[5] ..... A63H 18/06

[52] U.S. Cl. ..... 446/444; 238/10 R; 238/10 C

[58] Field of Search ..... 446/444, 445, 446, 488, 446/80, 456; 238/10 R, 10 A, 10 B, 10 C, 10 E, 10 F; 273/86 B, 86 R

[56] References Cited

U.S. PATENT DOCUMENTS

| | | | |
|---|---|---|---|
| 2,576,994 | 12/1951 | Bianchi et al. . | |
| 3,218,757 | 11/1965 | Benkoe | 446/444 |
| 3,860,237 | 1/1975 | Cooper et al. | 238/10 R X |
| 4,334,683 | 6/1982 | Campbell | 273/126 |
| 4,386,777 | 6/1983 | Prehodka | 446/444 X |
| 4,583,678 | 4/1986 | Weimer, Jr. | 229/39 |
| 4,713,012 | 12/1987 | Poplawski et al. | 434/373 |
| 4,726,516 | 2/1988 | Cree | 238/10 |
| 4,898,404 | 2/1990 | Babcock | 446/444 X |
| 5,000,715 | 3/1991 | Johnson | 446/427 |

*Primary Examiner*—Mickey Yu
*Attorney, Agent, or Firm*—Lathrop & Clark

[57] ABSTRACT

Die-cut corrugated paperboard blanks define a closed looped oval race track. The blanks form a flat roadway surface which is supported on paperboard wedges at an angle to provide banked straightaways and curves for the travel thereon of radio controlled battery powered cars. A paperboard barrier formed of a plurality of folded corrugated blanks is engaged against the elevated edges of the roadway to prevent the escape of the cars from the race track. The blanks which form the banked curves of the roadway have a plurality of radial slit scores which facilitate the bending of the corrugated paperboard blanks to approximate a frustroconical shape.

13 Claims, 5 Drawing Sheets

TOY CAR RACETRACK ASSEMBLED FROM MULTIPLE PAPERBOARD BLANKS

FIELD OF THE INVENTION

This invention relates to toy racetracks and cars in general and to racetracks adapted for use with radio controlled battery operated cars in particular.

BACKGROUND OF THE INVENTION

Racing model cars on model racetracks has long been a popular pasttime with children as well as adults.

In the past however, the cost of a model racetrack and model race cars has been high. Tracks for slot car racing which often incorporate guide slots and conducting strips for powering the cars have of necessity been costly. Further, the need for tight tolerances and rigidity inherent in tracks which have electrically conductive rails or mechanical drive means embedded in the track has resulted in the use of expensive materials such as molded plastic for track construction. Furthermore, the cost of the track has often resulted in racetracks which are of less than optimal size for providing the game with a sense of reality.

Recent advances in miniature electronics have reduced the cost of radio controlled cars and tremendously increased their popularity as a toy. However, without a racetrack, radio control cars are best used outside on a large, smooth driving area such as a playground or blocked driveway. However, outdoor use is dependent on the cooperation of the weather, and many potential users do not have ready access to a safe and convenient outdoor paved area. Furthermore, running on the rugged, possibly debris strewn asphalt and concrete of outdoor surfaces can be destructive to the toy cars.

What is needed is a low cost racetrack for use with radio controlled cars which may be easily and conveniently set up indoors and yet which is sufficiently challenging to provide many hours of skill development and racing fun.

SUMMARY OF THE INVENTION

The toy car racetrack of this invention is preferably constructed of corrugated paperboard and assembled entirely without adhesives or fasteners. The racetrack is formed from a number of identical cardboard wedges assembled from die-cut, corrugated cardboard blanks. The wedges support straight segments and banked curved segments of roadway made from paperboard blanks which provide a flat surface for the running of battery powered radio controlled cars. The wedges perform three functions. They support the roadway at a bank angle, and interface with the roadway through cardboard tabs attached to the elevated edge of the roadway which are inserted in slots in the uppermost edge of the wedges. The wedges also help to hold the segments of roadway together. The roadway is joined on its lower side by interlocking paperboard dovetails and on the elevated side by opposed tabs which fit within common slots in the sloping face of the wedges. Lastly, the wedges support a raised barrier which rings the raised edge of the roadway, forming a barrier which extends from the surface on which the roadway rests to several inches above the raised edge of the roadway. This barrier prevents cars from leaving the raised edge of the roadway thus preventing damage to the cars. The barrier, by confining the cars to the interior of the racetrack, greatly lessens the necessity of picking up and replacing the cars on the roadway.

It is an object of the present invention to provide a racetrack for use with radio controlled cars which may be fabricated from cardboard.

It is a further object of the present invention to provide a racetrack which may be assembled from corrugated blanks without the use of glue or fasteners.

It is another object of the present invention to provide a corrugated cardboard racetrack which may be sold as a set of cardboard blanks which can rapidly be assembled by an unskilled consumer.

It is also an object of the present invention to provide a cardboard racetrack with banked turns and a raised barrier which prevents radio controlled cars from leaving the raised edge of the track.

It is yet another object of the present invention to provide a racetrack constructed of paperboard which may have indicia printed on the roadway and the exterior of the barrier to provide an aesthetically pleasing and exciting toy.

It is an additional object of the present invention to provide a cardboard racetrack which may be readily disassembled for storage.

It is yet another object of the present invention to provide a paperboard racetrack which is resilient and easily repaired.

Further objects, features and advantages of the present invention will be apparent from the following detailed description when taken in conjunction with the accompanying drawings.

DESCRIPTION OF THE PREFERRED EMBODIMENT

Figure 1:
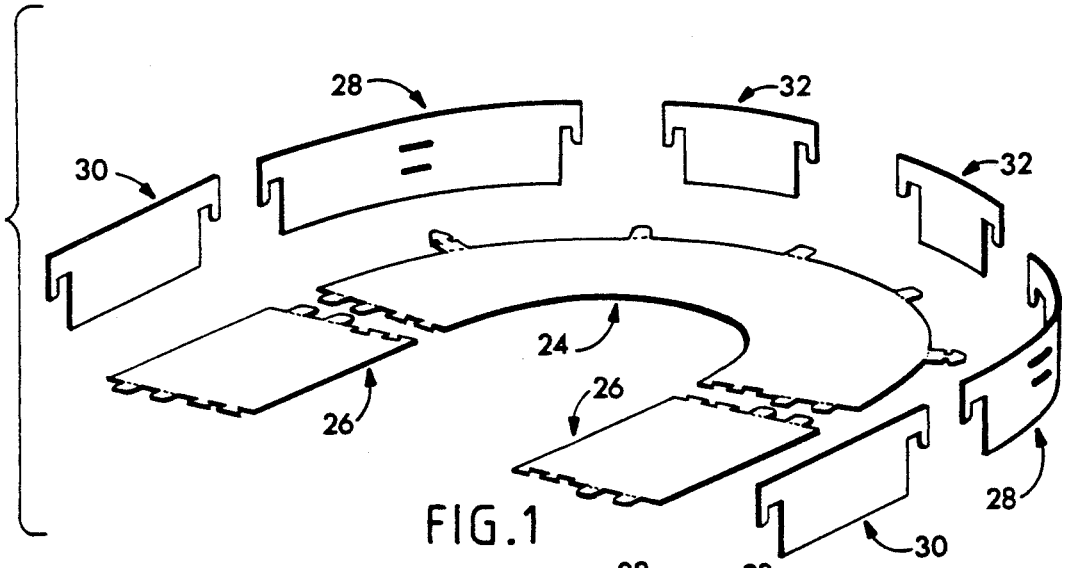
FIG. 1 is an exploded isometric view of a portion of the roadway and barriers of the toy racetrack.
Figure 2:
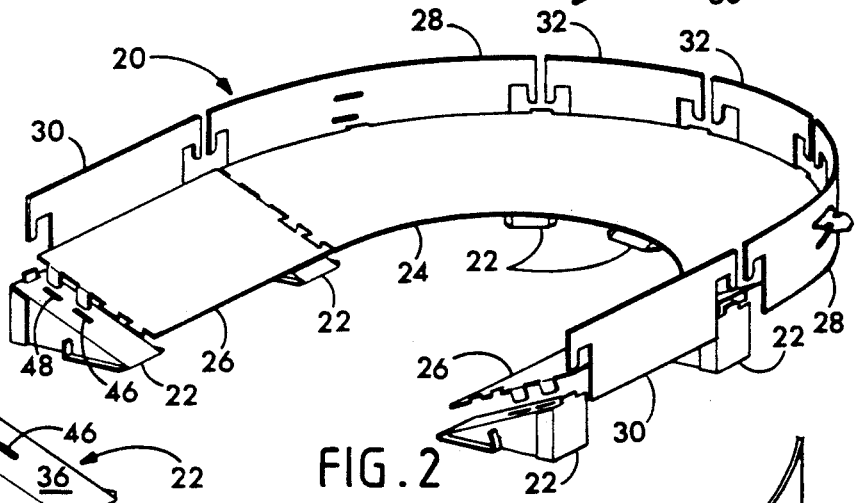
FIG. 2 is a partly exploded isometric view of a portion of the racetrack of this invention showing elevating wedges with the roadways of FIG. 1.
Figure 13:
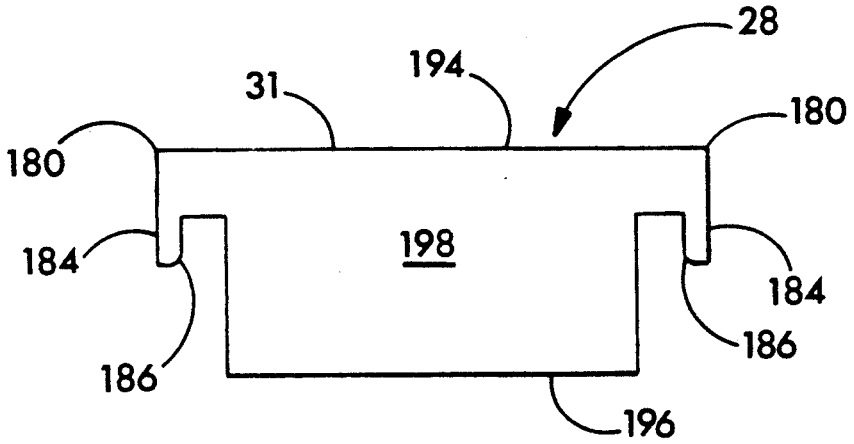
FIG. 13 is a plan view of the blank of the short barrier of FIG. 1.
Figure 14:
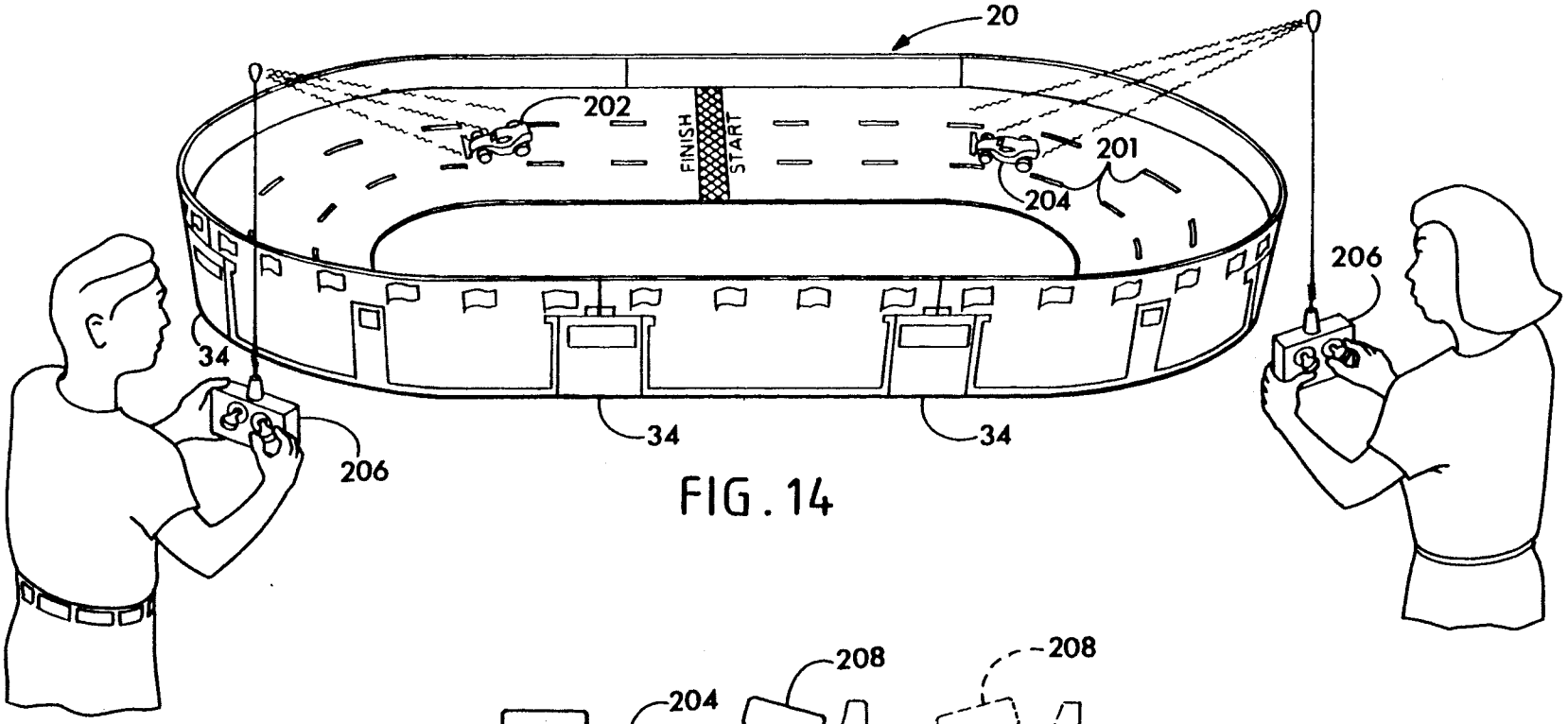
FIG. 14 is an isometric view showing the assembled racetrack of FIG. 2 and radio controlled cars in use.

Referring more particularly to FIGS. 1–15 wherein like numbers refer to similar parts, a racetrack 20 is shown in FIGS. 1, 2, and 14. The racetrack 20 is constructed from twenty-four cardboard blanks. There are six different types of blanks: wedges 22, curved roadway sections 24, straight-away road sections 26, long barrier sections 28, medium barrier sections 30, and short barrier sections 32. The racetrack 20 is constructed entirely from single layer corrugated paperboard blanks 22, 24, 26, 28, 30, 32 without the use of fasteners or glue. Assembly of the racetrack 20 is simple and rapid as illustrated in FIGS. 1, 2, 3, 4, 5, and 6 and can be accomplished in less than 10 minutes. Because no glue or tape is required in the assembly, the racetrack 20 may be disassembled for storage or transport.

Cardboard, or more specifically corrugated paperboard, comprises a first planar layer of material, a second planar layer of material, and an intermediate undulating layer of material attached between the first and second layers, usually by gluing. Corrugated paperboard is a conventionally available material and is available with a single layer of undulating or corrugation, or with double or triple layers.

The wedges 22 support the roadway sections 24, 26 at a constant incline. The barrier sections 28, 30, 32 are engaged with the roadway to prevent the escape of radio controlled cars from the racetrack 20.

Figure 10:
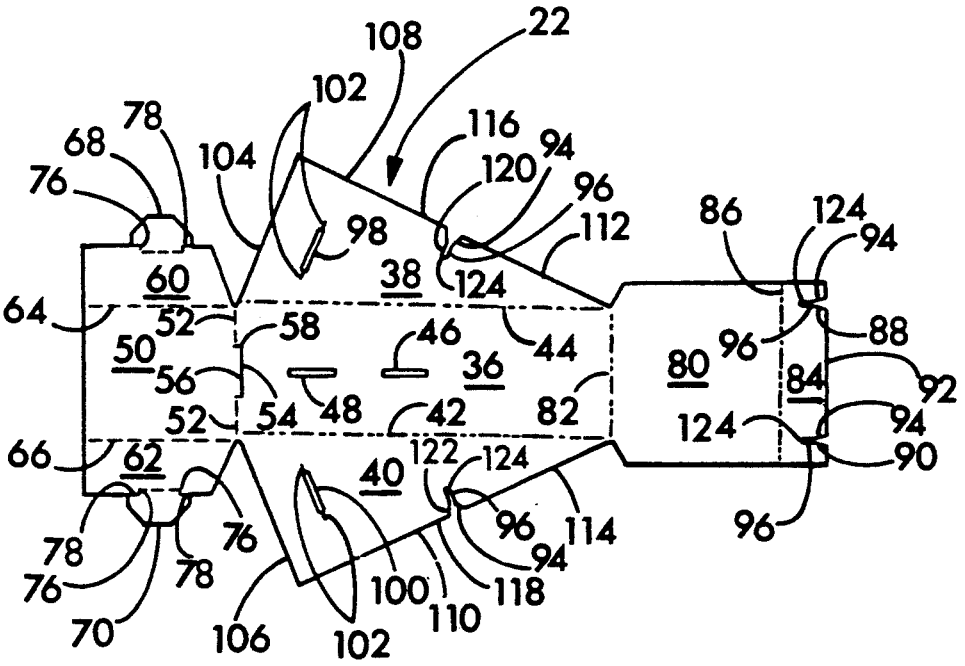
FIG. 10 is a bottom plan view of the blank of the elevating wedge of FIG. 5, showing cut lines, cut crease lines, and fold lines.
Figure 11:
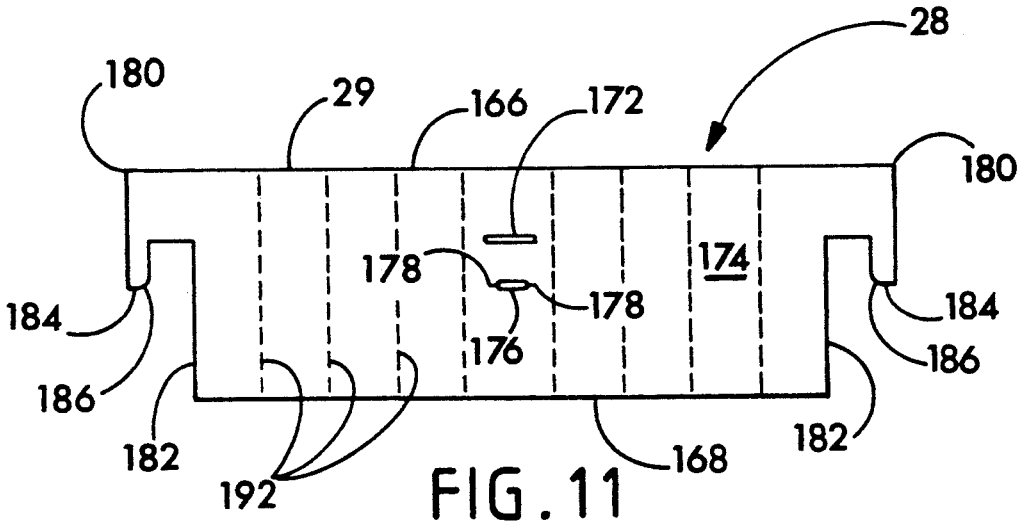
FIG. 11 is a plan view of the blank of the long barrier of FIG. 1.
Figure 12:
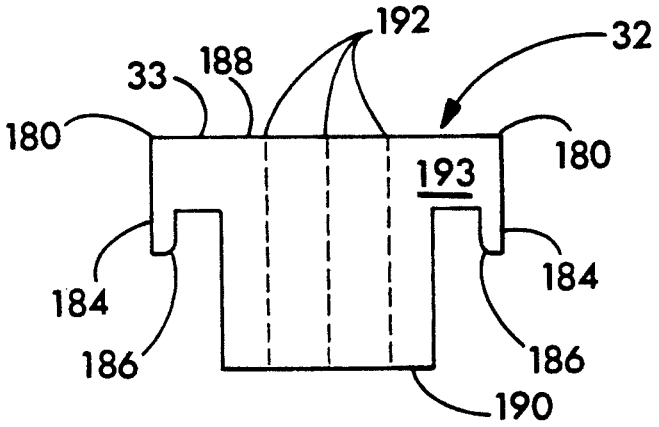
FIG. 12 is a plan view of the blank of a short length barrier of FIG. 1.

Each wedge blank 22, as shown in FIG. 10, has an inclined panel 36 on which the roadway 26, 24 is supported. Extending from the inclined panel 36 are two triangular flaps 38 and 40 which are joined to the inclined panel 36 along perforation crease lines 42, 44. The perforation crease lines 42, 44 are formed in the cardboard blank 22 by alternating cuts which are approximately a quarter inch long and which completely penetrate the cardboard from which the blank 22 is fabricated. Between the cuts are quarter inch sections of creased but uncut cardboard. Perforation crease lines are particularly useful where it is desirable to produce a hinge line in a cardboard blank with a precisely positioned hinge axis. The cuts in the perforation crease line precisely define the line along which the triangular flaps 38, 40 are hinged while the uncut, folded, segments form the hinge which retain the triangular flaps 38, 40 attached to the inclined panel 36. Crease score lines are formed by impressing a blunt blade against the corrugated blank to form an area along which folding may easily take place. Perforation crease lines are indicated in the figures by dashed lines with alternating double dots. Crease score lines are indicated by dashed lines with all dashes.

The inclined panel 36 has track attachment slots 46, 48 penetrating the thickness of the inclined panel 36. An upright panel 50 extends from the inclined panel 36 along fold lines 52. Between the crease score lines 52 is a cut out 54. When the upright panel 50 is folded downwardly with respect to the inclined panel 36, the cutout 54 forms a road positioning tab 56 and a barrier slot 58 best shown in FIGS. 5 and 7. Extending outwardly from the upright panel 50 are side flaps 60, 62 which are connected to the upright panel along crease score lines 64, 66. The side flaps 60, 62 in turn have locking tabs 68, 70 which are joined by crease score line 72, 74 to the side flaps 60, 62. Lock notches 76 are formed by right angle cut outs 78 when the locking tabs 68, 70 are folded upwardly at right angles to the side tabs 60, 62.

Extending from the inclined panel 36 opposite the upright panel 50 is a brace flap 80 which is joined to the inclined panel 36 along a perforation crease line 82. Extending from the brace flap 80 opposite the inclined panel 36 is a stand flap 84 which is in turn joined to the brace flap 80 along a perforation crease line 86.

The stand flap 84 has portions which define wedge slots 88, 90 which are indented from the edge 92 opposite the perforation crease line 82. The wedge slots 88, 90 are comprised of a wedge-shaped cutout 94 which terminates in a slot 96.

The triangular flaps 38, 40 have lock slots 98, 100 which serve to retain the locking tabs 68, 70. The triangular flaps 38, 40 define right triangles with the perforation crease lines 44, 42 defining the hypotenuse of the right triangle. The triangular flaps 38, 40 have short sides 104, 106 opposite the small angle and long sides 108, 110 opposite the greater angle. The long sides 110 in turn have relieved portions 112, 114 parallel to but set back approximately the thickness of the blank from long side edges 108, 110. These portions 112, 114 are relieved such that when the brace flap 80 is folded over to engage the relieved portions 112, 114 the combined thickness of the brace flap 80 and long side edges 108, 110 will lie in the same plane as the outer surface of the brace flap 80.

Where the relieved portions 112, 114 are adjacent to the unrelieved portions 116, 118 of the long sides 108, 110, portions of the triangular flaps define wedge slots 120, 122 which receive the brace flap 80.

Figure 5:
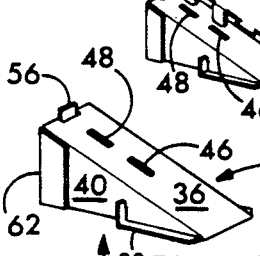
FIG. 5 is an isometric view of the fully assembled wedge of FIG. 4.
Figure 4:
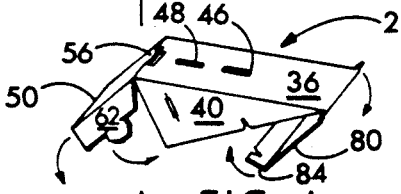
FIG. 4 is an isometric view of a partially assembled wedge of FIG. 3 with assembly arrows shown.
Figure 3:
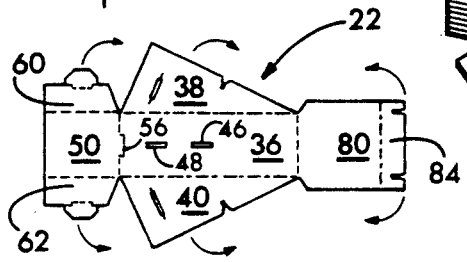
FIG. 3 is plan view of the blank of the wedge of FIG. 2 with arrows indicating assembly directions.

The assembly of the wedge 34 from the blank 22 is illustrated in FIGS. 3, 4, and 5. As shown in FIG. 3, the triangular flaps 38, 40 are first folded downwardly together with the upright panel 50 and the brace flap 80. In addition, the side flaps 60, 62 are folded inwardly while the locking tabs 68, 70 are folded outwardly. As shown in FIG. 4, the locking tabs 68, 70 are then pushed through the lock slots 98, 100 wherein the locking tabs 68, 70 pushed past the lock slits 102 which extend outward from the lock slots 98, 100. At this point the lock notches 76 formed by the right angle cutout 78 allow the locking slits 102 to close and so retain the locking tabs 68, 70 as shown in FIG. 5. As shown in FIG. 4, the stand flap 84 is folded along the perforation crease line 86 to bring the wedge slots 88, 90 alongside the wedge slots 120, 122. The wedge slots 88, 90, 120, 122 interlace at 90° to each other and serve to retain the brace flap 80 engaged with the relieved portions 112, 114 of the long sides 108, 110. The depth of the slot portions 96 is such that the slot bottoms 124 are separated from each other by a small gap, this gap provides for tolerances between the triangular flaps 38, 40 and the stand flap 84.

There are a total of ten wedge blanks 22 which are assembled into the wedges 34 to support the racetrack as shown in FIG. 14. Each wedge 34 provides a rigid and stable support for the roadway sections 24, 26, yet is easily disassembled for storage.

Each of the two curved roadway sections 24 are supported by five wedges 34 and are joined together by two straightaway road sections 26 to form a continuous closed loop racetrack roadway. The curved roadway section 24 is provided by a cardboard blank 25, best shown in FIG. 8. The blank 25 has an inner radius edge 126 and an outer radius edge 128. Perpendicular to the inner and outer radius edges 126, 128 are twenty-one radial slit score lines 130. The slit score lines 130 are cut into the bottom surface 131 completely cutting the bottom face sheet and preferably a majority of the corrugated inner sheet of the cardboard from which the blank 25 is fabricated. Slit score lines are indicated in the figures by dashed lines having alternating line segments and dots. The slit score lines 130 have the effect of creating radial hinge lines which allow the curved roadway section 24 to closely conform to a frustroconical surface. Because the scoring is on the bottom surface 131 of the blank 24, the roadway surface 132 above is continuous and unbroken and therefore provides a smooth surface for the driving of radio controlled cars 202, 204, thereon.

The radial slit scores 130 are more closely spaced towards the center 134 of the road section 24 thereby providing the most flexibility near the most curved portion of the road.

The curved roadway section 24 is connected to the five support wedges 34 by wedge tabs 136 and track tabs 138 which extend from the roadway section 24. The wedge tabs 136, which extend perpendicular to the direction of the roadway, are assembled to engage the support wedges 34 by being bent downwardly and inserted in the road support slots 58 adjacent to the road positioning tabs 56.

Figure 7:
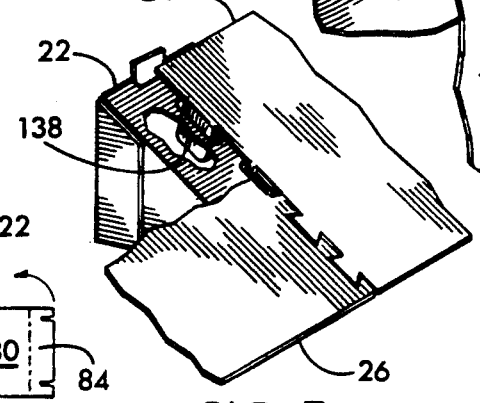
FIG. 7 is an enlarged isometric view, partly cut away, of a roadway joint and a support wedge of FIG. 2.
Figure 6:
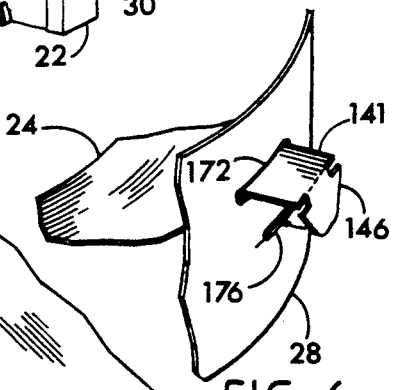
FIG. 6 is an enlarged isometric detail view of the locking tab of FIG. 2.
Figure 8:
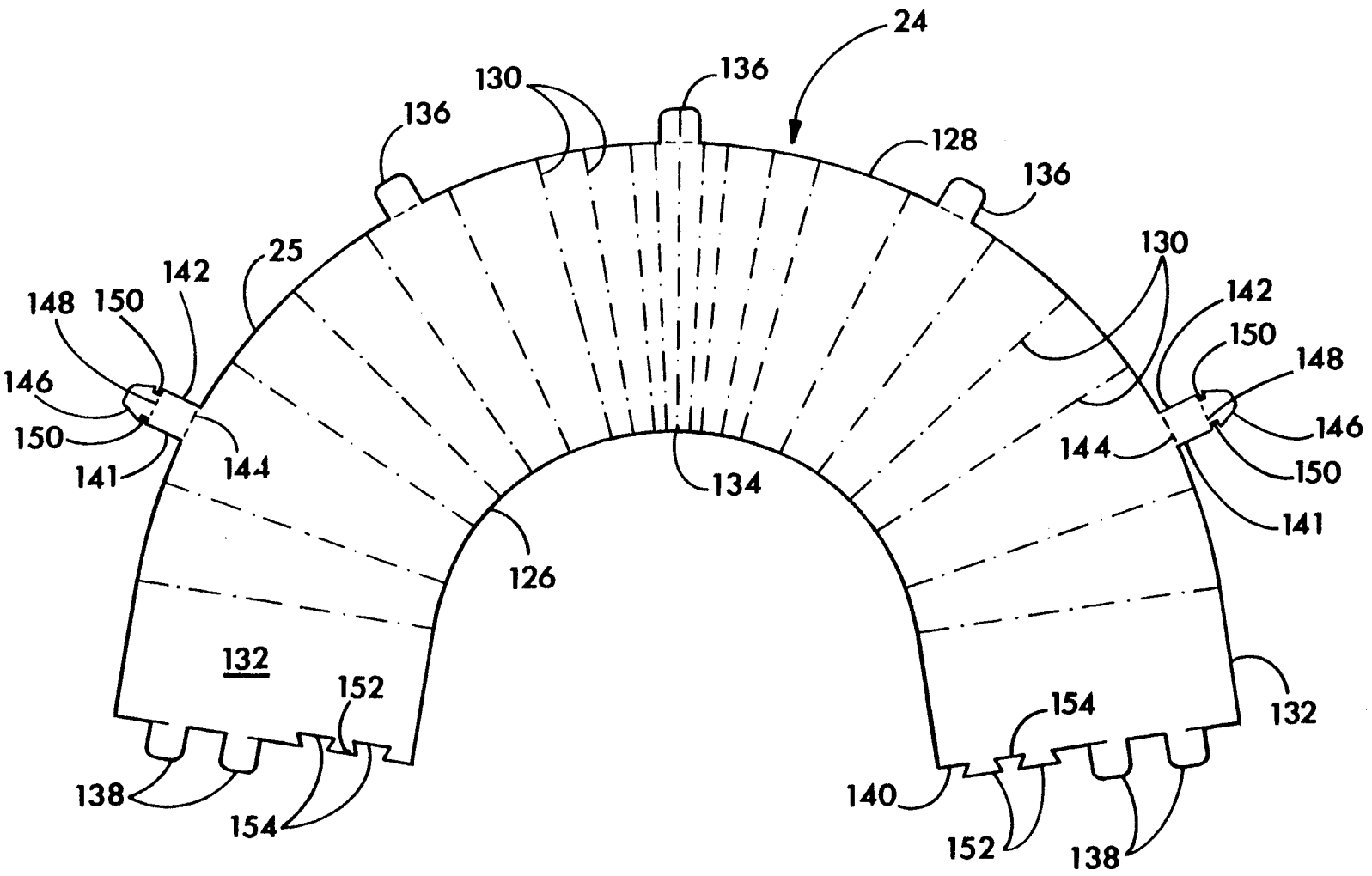
FIG. 8 is a bottom plan view of the curved portion of the roadway of FIG. 1 invention showing fold and score lines.

The track tabs 138 which extend in line with the direction of the roadway are inserted into the track tab slots 46, 48 in the inclined panel 36 of the wedge 34 as best shown in FIG. 7. Positioned between the ends 140 of the curved track 24 and the wedged tabs 136 are two lock tabs 141 which extend out from the outer radius edge 128. These tabs engage with long barrier sections 28. Each lock tab is comprised of a rectangular body portion 142 which is hinged along a crease score line 144 tangent to the outer radius edge 128. The lock tabs 141 have fold-over tabs 146 which are joined to the body portion 142 of the tab 141 along a crease score line 148. On either side of the fold-over tabs 146 are locking notches 150.

The curved roadway sections 24 are joined to the straightaway sections 26 by interlocking dovetails 152 and dovetail cutouts 154 which serve to join the roadway surface 156 of a straightaway 26 with the roadway surface 132 of a curved section 24. The dovetails 152 and dovetail cut-outs 154 serve to interlock the straightaway sections 26 with the curved sections 24 while presenting a smooth continuous roadway surface for the travel of model cars thereon.

Figure 9:
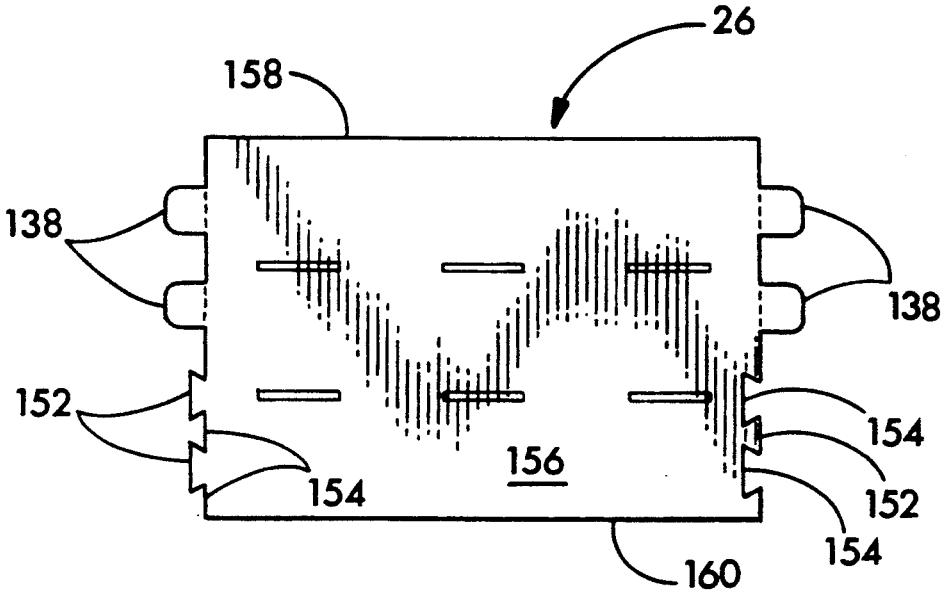
FIG. 9 is a bottom plan view of the blank of a straight roadway section of FIG. 2.

Each straightaway section 26 is formed from a cardboard blank 27 and is best shown in FIG. 9. Track tabs 138 extend from the straightaway section 26 and are inserted in the track slots 48, 46 in the inclined panel 36 of the triangular support wedge 34 adjacent to the track tabs 138 of the curved section 24. The width of the track tab slots 46, 48 is such as to snuggly hold the track tabs 138 adjacent one another, thereby joining the straightaway sections 26 with the curved sections 24. The track tabs 38 in combination with the dovetails 152 and dovetail cut-outs 154 provide a secure but smooth connecting interface between the straightaways 26 and the curved roadway sections 24.

As installed in the racetrack 20, the straightaway sections have an elevated edge 158 which is adjacent to the track tabs 138 and a lower edge 160 adjacent to the dovetails 152. Once the two curved roadway sections 24 have been attached to their five corresponding wedges 34 and have been joined by straightaway sections 26 the roadway 162 of the racetrack 20 is complete. The banking of the curved sections of the roadway 162 advantageously serves to assist in retaining cars on the roadway, especially as the cars negotiate the curves. The banked track also effectively simulates the appearance of a real race track.

The barrier 164 along the raised edge of the roadway 162 is composed of ten barrier sections of three different types which are installed next. Each long barrier 28, best shown in FIG. 11, has an upper edge 166 and a lower edge 168. The lower edge 168 rests on the ground or other support surface and the upper edge 166 forms the top of the roadway barrier which prevents model cars 202, 204 from leaving the track and so damaging themselves or necessitating the laborious effort of retrieving the car and placing it once again within the racetrack.

The long barrier section 28 is formed from a cardboard blank 29 and the blank 29 is rendered flexible so as to conform to the curves of the curved section 24 by a series of crease score lines 192 which extend from the upper edge 158 to the lower edge 164 of the long barrier 28. Centrally located and at a height so as to be adjacent to the elevated edge of the curved track section 24 is a pass-through slot 172 which receives the locking tabs 141 which are pulled through the pass-through slots 172 until the roadway is adjacent to the surface 174 of the long barrier 28. Located beneath and aligned with the pass-through slot 172 is a locking slot 176 which is smaller than the pass through slot but which has horizontally extending locking slits 178 which extend from the ends of the locking slot 176. The locking slot 176 receives a fold-over tab 146 of the curved road section 24 and locks the tab 146 to the barrier section 28 through the cooperation of the locking slits 178 in the barrier 28 and the locking notches 150 in the locking tabs 141 of the curved roadway section 24.

The long barrier 28 has extending ears 180 which extend outwardly from the ends 182 of the barrier 28. The ears have downwardly depending stakes 184. The stakes 184 have a smooth radiused corner 186 opposite the barrier ends 182. The stakes are inserted into slots 58 of the wedges 34 between the tabs 56 and the roadway 26, 24 the wedge tabs 136. Each slot 58 receives two stakes 184 from two adjacent barrier sections 30, 28, 32. The radiused corners 186 on the stakes 184 serve to facilitate the insertion of the stakes by guiding them into the slots 58 of the wedges 34.

Similarly, each short barrier section 32 is formed from a short barrier bank 33 has an upper edge 188 and lower edge 190 and crease score lines 192 which allow the short sections 32 to conform to the upper peripheral edge 128 on either side of the center 134 of the curved section 24. The short barrier has an inner surface 193 adjacent the roadway. The short barrier sections 32 also have ears 180 and depending stakes 184 with radiused corners 186 which in a manner similar to the stakes on the long barrier sections are inserted in the slots 58 of the wedges 34.

As shown in FIG. 13, medium barrier sections 28 are aligned along the raised peripheral edges 158 of the straightaway sections 26 and have upper edges 194 and lower edges 196.

The medium barrier section 28 formed from medium barrier blank 31 and has an inner surface 198 which is adjacent to the straightaway road sections 26 and an outer surface 200 which is suitable for the placement of indicia or ornamental designs.

Each medium barrier sections 28 is connected to the wedges 34 by means of stakes 84 which depend from ears 180.

The barrier sections 28, 30, 32 advantageously retain the cars 202, 204 on the roadway, particularly when the cars are controlled by inexperienced racers. Because a certain level of skill is required to accurately control and steer the cars, initially a driver will find it difficult to position a car in the center of the roadway. The barriers allow the cars to make a full circuit of the roadway with steering provided by the engagement of the car with the barriers. Absent the barrier the cars would leave the surface of the elevated portions of the roadway at the first erroneous steering signal from a novice driver. Cars which leave the roadway surface at the lower portion can be driven back onto the roadway remotely without the need to manually replace the car.

The racetrack, because of its construction from corrugated paperboard blanks, is easily repaired with readily available adhesive tapes. Should the blanks be torn or damaged, the injured area may be rapidly repaired and the racetrack returned to operational condition.

The racetrack 20, as shown in FIG. 14, may be of any size suited to the dimensions of the particular radio controlled cars to be driven thereon, but an exemplary roadway has a dimension of 92 inches by 54 inches with a peripheral barrier height of 10 inches and a roadway slant width of 16 inches. These large dimensions are possible at modest cost due to the low cost of the materials and fabrication entailed by the cardboard construction of the racetrack 20.

As shown in FIG. 14, the roadway will preferably have indicia in the form of lane markers 201 which delineate lanes on the roadway surface. It will further be convenient to have a start and finish line demarcated perpendicular to the roadway to facilitate the conducting of races on the toy race track 20.

The track is employed with radio controlled model cars 202, 204 with each car being controlled by a radio transmitter 206. In order to independently control multiple race cars, each car 202, 204 should be controlled by a transmitter 206 employing a different control frequency. For instance, one car may be controlled by a frequency of 49.860 MHz and the other by a frequency of 27.145 MHz.

Figure 15:
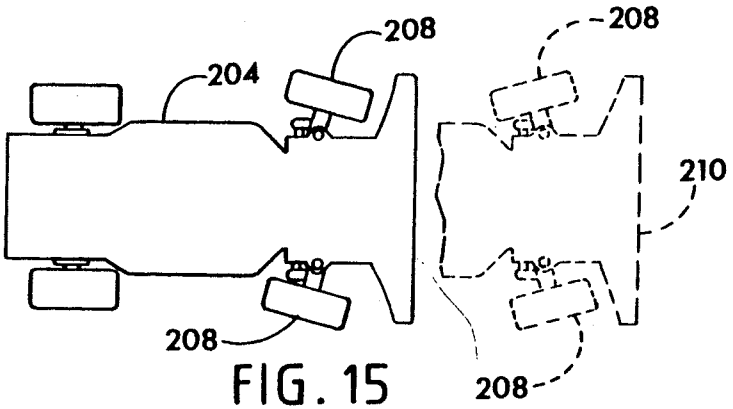
FIG. 15 is a bottom view of a radio controlled car of FIG. 14 showing the bidirection steering capability.

The radio controlled cars have at a minimum the capability to stop and start and steer, and preferably are able to steer in two directions and be capable of reversing direction. As shown in FIG. 15 the wheels 208 are steerable as shown in phantom position 210 to direct the car.

Although the racetrack 20 is shown as an oval, it should be understood that other shapes could be used such as a circle, an elipse, a tri-oval, a road course, or a figure eight. It should also be understood that although the entire roadway is shown banked at a constant angle, it is only necessary to bank the curved portions of the roadway convexly toward the center of curvature in order to achieve maximum controlled speeds through the curved portions of the raceway. Therefore, it is not necessary that the straight portions of the roadway be banked. It will in most cases be advantageous to provide the straightaways with barrier sections to prevent the cars from leaving the confines of the track, although barriers for unbanked straight sections are not necessary, as a car leaving the track while on the straightaway does not drop to the ground and may be readily directed by means of the radio control to return to the roadway.

It should be understood that although the preferred material of construction is 3-ply corrugated cardboard, any paperboard product with sufficient flexibility and tear strength could be used to fabricate the racetrack 20. It should be noted that where cut crease lines, fold lines and slit score lines are shown, any means for rendering the cardboard flexible and hinged could be used.

It should also be understood that the invention is not confined to the particular construction and arrangement of parts herein illustrated and described, but embraces such modified forms thereof as come within the scope of the following claims.

We claim:

1. A kit for the construction of a toy racetrack for radio controlled cars, comprising:

a) a plurality of first blanks having portions defining a curved roadway having an inner edge and an outer edge, and portions of each first blank defining radial slits which extend from the inner edge to the outer edge, the radial slits facilitating the bending of the first blank to form a curved, banked roadway section, the first blanks being joinable to form a continuous roadway for the travel of radio controlled toy cars thereon, wherein the first blanks are adapted to being erected on a support surface such that the roadway inner edge engages said support surface and the roadway outer edge is elevated above the support surface; and b) a plurality of second blanks which are foldable to engage the outer edge of the first blanks and which are adapted to form a continuous barrier which extends above and is separate from the roadway for the retention of toy cars on the roadway, wherein each blank is formed of corrugated material having a first planar layer, a second planar layer, and an intermediate undulating layer attached between the first and second layers.

2. The kit of claim 1 further comprising at least one roadway straightaway blank, the straightaway blank having portions defining a straight roadway and adapted to engage with a first blank to form a continuous roadway.

3. A toy car racetrack assembly comprising:

a) at least one paperboard blank forming a closed looped roadway having an inner and an outer edge, the roadway defining a direction of travel, and forming a continuous path, the roadway having indicia aligned parallel to the direction of travel which delineate a plurality of lanes along the roadway, the roadway having curved portions, which are inclined from a horizontal plane, the inclined portions having elevated outer edges, wherein the inner edge of the inclined roadway engages a support surface and the outer edge is elevated above the support surface;

b) at least one radio controlled toy car having bidirectional control and being battery powered and being remotely operable to drive on the roadway; and c) a barrier which extends vertically above the roadway and which is separate from the roadway, wherein the barrier prevents cars from leaving the roadway along the roadway outer edge.

4. The assembly of claim 3 wherein a radio receiver is incorporated into the toy car, and further comprising a radio transmitter located at a location spaced from the car to allow remote operation of the car.

5. A toy racetrack formed of paperboard for use with radio controlled toy cars comprising:

a) at least one paperboard blank folded to form a roadway surface adapted for use with controlled toy cars, wherein portions of the roadway surface are inclined to form a banked roadway having an inner edge and an outer edge, and wherein the banked portions have an inner edge which engages a support surface and an elevated roadway outer edge; and b) at least one paperboard barrier blank separate from and adjacent to the elevated roadway edge, the engaged blank extending above the roadway surface to form a barrier to prevent remotely operated toy cars from leaving the roadway surface over the elevated roadway edge.

6. The toy racetrack of claim 5 further comprising a plurality of paperboard blanks with portions defining a straightaway roadway section, and the straightaway sections are engaged with two curved roadway sections to define an oval looped roadway.

7. The toy racetrack of claim 5 wherein the entire roadway is banked and the barrier extends continuously along the elevated edge of the roadway.

8. The toy racetrack of claim 5 further comprising indicia on the surface of the roadway defining a plurality of lanes.

9. The apparatus of claim 5 wherein the roadway is comprised of a plurality of paperboard segments, the segments being nonadhesively joined to form a surface for the uninterrupted travel thereon of toy radio controlled race cars.

10. The toy racetrack of claim 5 wherein the paperboard blanks forming the roadway and the barriers are nonadhesively joined to one another.

11. The toy racetrack of claim 5 wherein the roadway has a peripheral edge opposite the elevated edge which engages against a support surface, and wherein the barrier extends downwardly from the elevated peripheral edge to engage the support surface.

12. The toy racetrack of claim 5 wherein the barrier surface opposite the roadway is marked with indicia simulative of an outdoor racetrack.

13. The toy racetrack of claim 5 wherein the roadway forms a continuous closed path.

* * * * *